US009382088B2

(12) United States Patent
Miura et al.

(10) Patent No.: US 9,382,088 B2
(45) Date of Patent: Jul. 5, 2016

(54) SHEET CONVEYING DEVICE AND IMAGE READING DEVICE

(71) Applicant: Brother Kogyo Kabushiki Kaisha, Nagoya-shi, Aichi-ken (JP)

(72) Inventors: Katsuro Miura, Toyota (JP); Tsuyoshi Suganuma, Nagoya (JP); Takuya Naniwa, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/497,446

(22) Filed: Sep. 26, 2014

(65) Prior Publication Data

US 2015/0091240 A1 Apr. 2, 2015

(30) Foreign Application Priority Data

Sep. 27, 2013 (JP) ..... 2013-202227

(51) Int. Cl.
*B65H 1/04* (2006.01)
*B65H 29/22* (2006.01)
(Continued)

(52) U.S. Cl.
CPC ..... *B65H 29/22* (2013.01); *B65H 1/04* (2013.01); *B65H 3/06* (2013.01); *B65H 3/0684* (2013.01); *B65H 3/68* (2013.01); *B65H 5/062* (2013.01); *B65H 29/14* (2013.01); *B65H 31/02* (2013.01); *B65H 3/5223* (2013.01); *B65H 3/5238* (2013.01); *B65H 2301/4212* (2013.01); *B65H 2301/4213* (2013.01); *B65H 2402/46* (2013.01); *B65H 2404/1531* (2013.01); *B65H 2404/6111* (2013.01); *B65H 2405/115* (2013.01);
(Continued)

(58) Field of Classification Search
CPC ..... B65H 2405/11; B65H 2405/1111; B65H 2405/1112; B65H 2405/113; B65H 2405/1136; B65H 2405/1142; B65H 2511/12
USPC ..... 271/171
See application file for complete search history.

(56) References Cited

U.S. PATENT DOCUMENTS 4,613,124 A * 9/1986 Lohrmann ..... B41J 13/103 271/127
5,346,197 A * 9/1994 Takano ..... B65H 1/04 271/127
(Continued)

FOREIGN PATENT DOCUMENTS

JP 2002-145457 A 5/2002
JP 2005-020667 A 1/2005
(Continued)

*Primary Examiner* — Jeremy R Severson
(74) *Attorney, Agent, or Firm* — Banner & Witcoff, Ltd.

(57) ABSTRACT

A sheet conveying device includes a conveyor, a supporting section which supports a sheet to be fed to the conveyor and a guide section which is provided on the supporting section and configured to guide a sheet to the conveyor. The supporting section includes a first support region and a second support region which support a sheet. The first support region is provided at a position on an upstream side from the second support region in a sheet conveyance direction. The first support region extends substantially horizontally, and the second support region is inclined in a lower direction toward the downstream side in the conveyance direction. The guide section includes a first portion which extends substantially horizontally along the first support region, and a second portion which is connected to the first portion and extends obliquely in the lower direction along the second support region.

12 Claims, 10 Drawing Sheets

(51) Int. Cl.

| | |
|---|---|
| ***B65H 3/06*** | (2006.01) |
| ***B65H 3/68*** | (2006.01) |
| ***B65H 5/06*** | (2006.01) |
| ***B65H 29/14*** | (2006.01) |
| ***B65H 31/02*** | (2006.01) |
| *B65H 3/52* | (2006.01) |

(52) U.S. Cl.

CPC ..... *B65H2405/1111* (2013.01); *B65H 2405/111646* (2013.01); *B65H 2405/324* (2013.01); *B65H 2405/3321* (2013.01); *B65H 2511/12* (2013.01); *B65H 2511/22* (2013.01); *B65H 2801/06* (2013.01); *B65H 2801/39* (2013.01)

(56) References Cited

U.S. PATENT DOCUMENTS

| | | | | |
|---|---|---|---|---|
| 6,612,561 | B2 | 9/2003 | Sekine | |
| 7,392,009 | B2 | 6/2008 | Iwago | |
| 7,578,500 | B2 * | 8/2009 | Tsuchida | 271/171 |
| 8,141,868 | B1 * | 3/2012 | Wang et al. | 271/171 |
| 8,941,849 | B2 * | 1/2015 | Ohtsuka et al. | 358/1.13 |
| 2002/0056957 | A1 | 5/2002 | Sekine | |
| 2004/0263921 | A1 | 12/2004 | Iwago | |
| 2009/0311020 | A1 * | 12/2009 | Shoji | G03G 15/602 399/367 |
| 2010/0252987 | A1 * | 10/2010 | Furuyama | B65H 1/04 271/3.14 |
| 2011/0175282 | A1 * | 7/2011 | Sagawa et al. | 271/258.01 |
| 2012/0155941 | A1 | 6/2012 | Kozaki et al. | |

FOREIGN PATENT DOCUMENTS

| | | | |
|---|---|---|---|
| JP | 4397632 | B2 | 1/2010 |
| JP | 2010-245624 | A | 10/2010 |
| JP | 2012-126530 | A | 7/2012 |

* cited by examiner

SHEET CONVEYING DEVICE AND IMAGE READING DEVICE

CROSS-REFERENCE TO RELATED APPLICATION

This application claims priority from Japanese Patent Application No. 2013-202227, filed on Sep. 27, 2013, the entire subject matter of which is incorporated herein by reference.

TECHNICAL FIELD

The following disclosure relates to a sheet conveying device and an image reading device.

BACKGROUND

There has been known an image reading device which includes an automatic document feeder (ADF), wherein a sheet feed tray is entirely inclined from an upstream end to a downstream end in a sheet conveyance direction.

In this sheet feed tray, a dimension of the sheet feed tray from an upper end position to a lower end position in a height direction becomes large, which prevents a thickness-reduction of the device.

Here, although an inclination of the sheet feed tray is similar amount, if a full length of the sheet feed tray (a dimension in a direction parallel to the sheet conveyance direction) is reduced, it is possible to reduce the dimension of the sheet feed tray in the height direction. However, in this case, if a sheet having a long length in the sheet conveyance direction is loaded on the sheet feed tray, a portion of the sheet is likely to protrude.

SUMMARY

Accordingly, an aspect of the disclosure relates to a sheet conveying device and an image reading device which can secure an area sufficient for supporting a sheet and reduce a height dimension of a space necessary for securing the area.

In one aspect of the disclosure, a sheet conveying device includes a conveyor, a first supporting section and a guide section. The conveyor is configured to convey a sheet along a predetermined conveyance path in a conveyance direction. The first supporting section is configured to support a sheet to be fed to the conveyor, from a lower side of the sheet. The guide section is provided on the first supporting section and configured to guide a sheet to be fed from the first supporting section to the conveyor. The first supporting section includes a first support region and a second support region, each of which is configured to support a sheet. The first support region is provided at a position on an upstream side with respect to the second support region in the conveyance direction, and the second support region is provided at a position on a downstream side with respect to the first support region in the conveyance direction. The first support region extends substantially horizontally, and the second support region is inclined in a lower direction toward the downstream side in the conveyance direction. The guide section includes a first portion which extends substantially horizontally along the first support region, and a second portion which is connected to the first portion and extends obliquely in the lower direction along the second support region.

According to the above configuration, in the first supporting section and the guide section, portions on the upstream side in the conveyance direction extend substantially horizontally, whereas portions on the downstream side in the conveyance direction extend obliquely in a lower direction toward the downstream side in the conveyance direction. Therefore, the first supporting section reduces the height of the vicinity of the first support region as compared to a related-art device in which the whole of the first supporting section including a portion located on the upstream side in the conveyance direction is inclined. Therefore, it is possible to reduce the thickness of the device.

In another aspect of the disclosure, an image reading device includes a conveyor, a first supporting section, a guide section and a reading section. The conveyor is configured to convey a sheet along a predetermined conveyance path in a conveyance direction. The first supporting section is configured to support a sheet to be fed to the conveyor, from a lower side of the sheet. The second supporting section is configured to support a sheet discharged from the conveyor, from the lower side of the sheet. The guide section is provided on the first supporting section and configured to guide a sheet to be fed from the first supporting section to the conveyor. The reading unit is configured to read an image of a sheet conveyed by the conveyor. The first supporting section includes a first support region and a second support region, each of which is configured to support a sheet. The first support region is provided at a position on an upstream side with respect to the second support region in the conveyance direction, and the second support region is provided at a position on a downstream side with respect to the first support region in the conveyance direction. The first support region extends substantially horizontally, and the second support region is inclined in a lower direction toward the downstream side in the conveyance direction. The guide section includes a first portion which extends substantially horizontally along the first support region, and a second portion which is connected to the first portion and extends obliquely in the lower direction along the second support region.

According to the above configuration, the image reading device includes the configuration of the above-described sheet conveying device. Therefore, the first supporting section reduces the height of the vicinity of the first supporting section as compared to a related-art device in which the whole of the first supporting section including a portion located on the upstream side in the conveyance direction is inclined. Therefore, it is possible to reduce the thickness of the device.

BRIEF DESCRIPTION OF THE DRAWINGS

For a more complete understanding of the present disclosure, needs satisfied thereby, and the objects, features, and advantages thereof, reference now is made to the following illustrative descriptions taken in connection with the accompanying drawings.

FIGS. 2A and 2B are views showing an internal structure of an image reading device, wherein FIG. 2A is a vertical cross-sectional view showing a state where a second cover of an ADF section is closed, and FIG. 2B is a vertical cross-sectional view showing a state where the second cover is opened;

DETAILED DESCRIPTION

Hereinafter, a sheet conveying device and an image reading device according to an illustrative embodiment will be described.

[Structure of Multi-Function Device]

Figure 1:
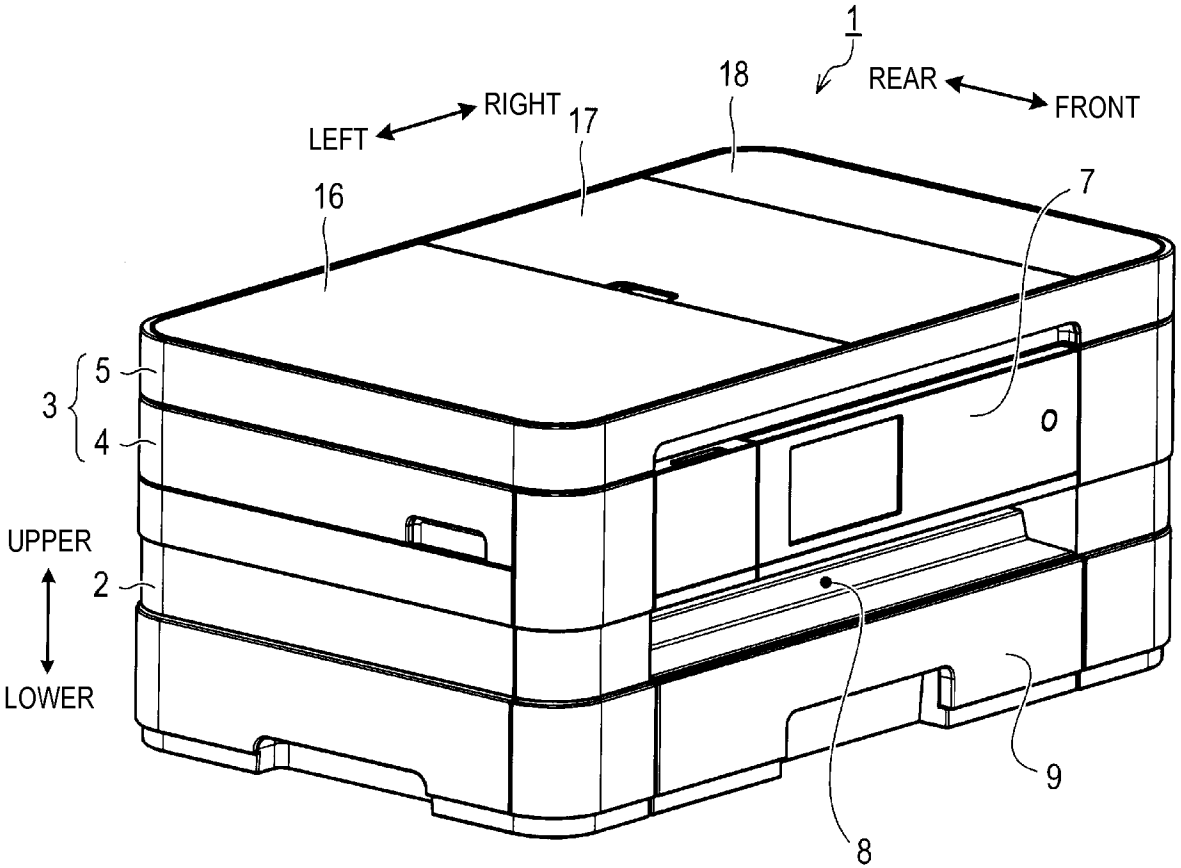
FIG. 1 is a perspective view showing a multi-function device according to an illustrative embodiment.

A multi-function device 1 shown in FIG. 1 includes a configuration corresponding to a sheet conveying device and an image reading device according to an illustrative embodiment. In the following description, individual sections of the multi-function device 1 will be described with reference to directions, that is, an upper side, a lower side, a left side, a right side, a front side and a rear side shown in the drawings for simply explaining the relative positional relation among the individual sections.

The multi-function device 1 includes a main body unit 2, and a reading unit 3 which is mounted on an upper side of the lower unit 2. The reading unit 3 is attached to the main body unit 2 so as to be openable and closable. When the reading unit 3 is closed, an opening formed on an upper surface side of the main body unit 2 is closed by the reading unit 3.

The reading unit 3 includes a flat bed section (hereinafter, referred to as FB section) 4, and an ADF section 5 which is provided on an upper side of the FB section 4. The ADF section 5 is attached to the FB section 4 so as to be openable and closeable. When the ADF section 5 is closed, the ADF section 5 functions as a cover for covering an upper surface side of the FB section 4.

The main body unit 2 includes therein a control section, an image forming section, a LAN communication section, a PSTN communication section, and the like. At an upper front portion of the main body unit 2, an operation panel 7 which can be operated by a user is provided. At a lower side of the operation panel 7, an outlet 8 for taking out recording media having been subjected to image forming in the image forming section is formed. At a lower side of the outlet 8, a medium feeding cassette 9 for storing recording media to be fed to the image forming section is provided.

Figure 2A:
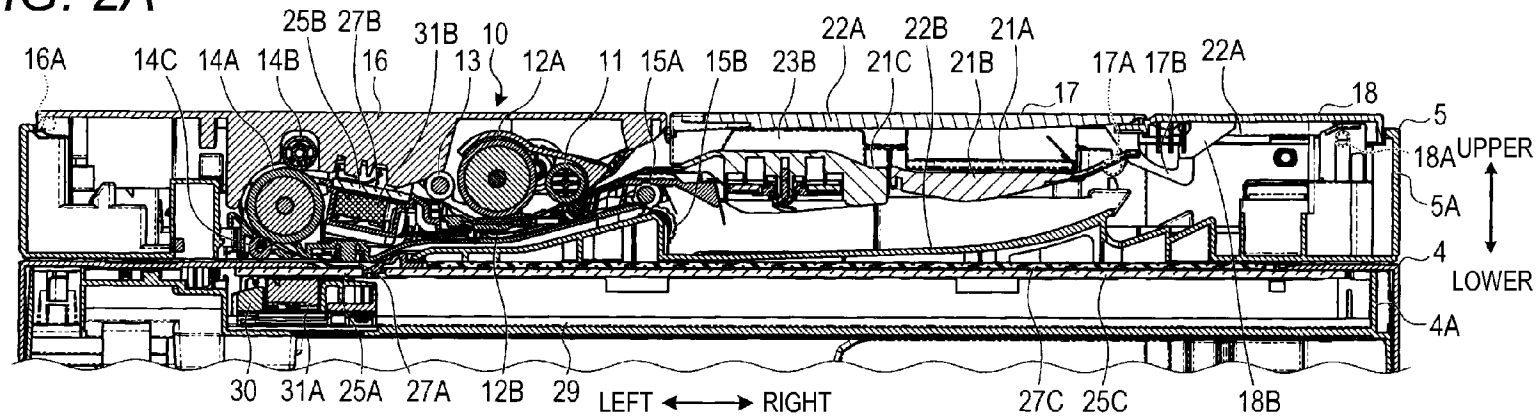
Figure 2B:
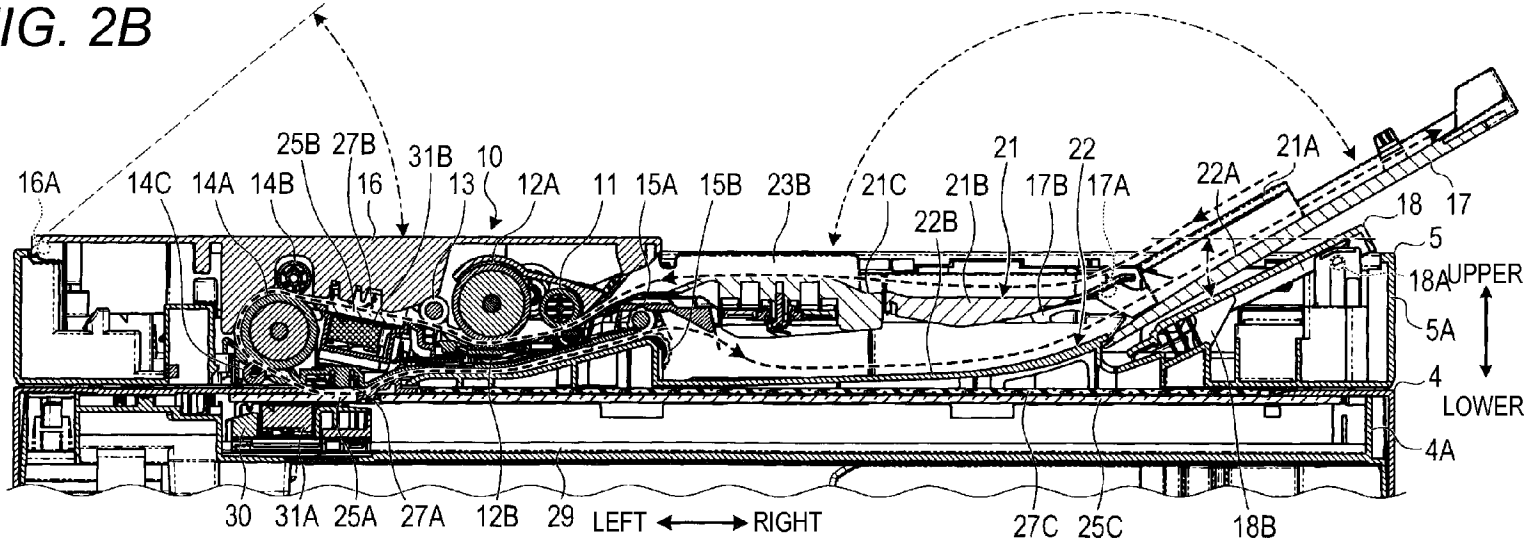

In the reading unit 3, the ADF section 5 includes a conveyor 10 configured to convey original documents along a predetermined conveyance path (see a path shown by a thick broken line in FIG. 2B) as shown in FIGS. 2A and 2B. The conveyor 10 includes a feed roller 11, a separation roller 12A, a separation piece 12B, a relay roller 13, a conveying roller 14A, an upper pinch roller 14B, a lower pinch roller 14C, a discharging roller 15A, a discharge pinch roller 15B, and so on. The conveyance path is defined by these various rollers, guide surfaces positioned between adjacent rollers, and the like.

At an upper surface of the ADF section 5, a first cover 16, a second cover 17 and a third cover 18 are provided as shown in FIGS. 1, 2A and 2B. The first cover 16 is configured to be rotatable around a rotating shaft 16A positioned in the vicinity of a left end of the first cover 16, such that a right end side of the first cover 16 rises. The second cover 17 is configured to be rotatable around a rotating shaft 17A positioned in the vicinity of a right end of the second cover 17, between a storage position shown in FIG. 2A and a use position shown in FIG. 2B. The third cover 18 is configured to be rotatable around a rotating shaft 18A positioned in the vicinity of a right end of the third cover 18, between a horizontal position shown in FIG. 2A and an inclined position shown in FIG. 2B.

When the second cover 17 and the third cover 18 are positioned at the positions shown in FIG. 2A, an arm 17B extending from the second cover 17 is engaged to an arm receiver 18B of the third cover 18. That is, while the arm 17B from the second cover 17 supports the third cover 18 from a lower side, the second cover 17 and the third cover 18 form a horizontal plane. Here, the horizontal plane which is formed by the second cover 17 and the third cover 18 is not limited to a perfectly flat plane, and may have some irregularities, or may include an inclined portion or the like. Further, from this state, if the second cover 17 is rotated from the storage position to the use position, the arm 17B is moved toward a lower side, thereby pulling the vicinity of the left end of the third cover 18 to a lower side. As a result, in conjunction with the rotation of the second cover 17, the third cover 18 rotates from the horizontal position shown in FIG. 2A to the inclined position shown in FIG. 2B.

If the second cover 17 rotates from the storage position to the use position, the third cover 18 reaches the inclined position before the second cover 17 reaches the use position. However, thereafter, the arm 17B gets out from the arm receiver 18B, whereby the second cover 17 reaches the use position without moving the third cover 18. Meanwhile, if the second cover 17 rotates from the use position to the storage position, first, the second cover 17 rotates without moving the third cover 18, and before the second cover 17 reaches the storage position, the arm 17B enters the arm receiver 18B. Then, the arm 17B raises up the vicinity of the left end of the third cover 18 until the second cover 17 reaches the storage position. As a result, the third cover 18 rotates in conjunction with the second cover 17, whereby the third cover 18 reaches the horizontal position substantially at the same time as the second cover 17 reaches the storage position.

When the second cover 17 is moved to the use position, in the ADF section 5, a first supporting section 21 configured to support an original document to be fed to the conveyor 10, from a lower side of the original document, and a second supporting section 22 configured to support an original document to be discharged from the conveyor 10 from a lower side of the original document are provided. The first supporting section 21 is provided on an upper side of the second supporting section 22, and includes a first upper support 21A, a second upper support 21B and a third upper support 21C. The second supporting section 22 is provided on a lower side of the first supporting section 21, and includes a first lower support 22A and a second lower support 22B.

Figure 3:
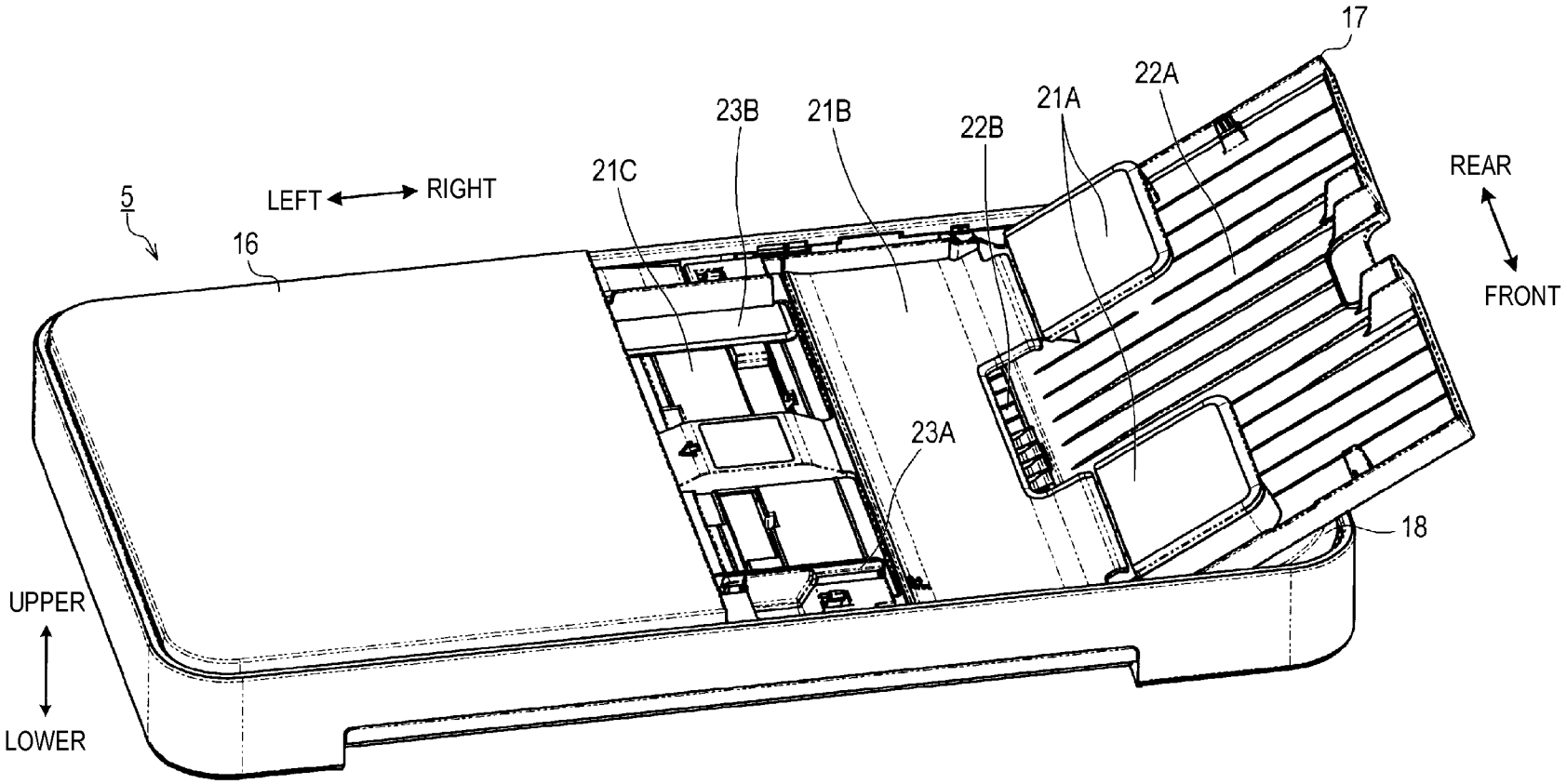
FIG. 3 is a perspective view showing the state where the second cover is opened.

The first upper support 21A is attached to the second cover 17 as shown in FIGS. 2A, 2B and 3, and rotates together with the second cover 17. The second upper support 21B is attached to a housing 5A of the ADF section 5 so as to be openable and closeable. When the second upper support 21B is opened, a portion of the second lower support 22B positioned on a lower side of the second upper support 21B is exposed. The third upper support 21C is attached to the housing 5A of the ADF section 5. The first lower support 22A is configured by one surface of the second cover 17. The second lower support 22B is configured by a bottom portion of the housing 5A of the ADF section 5.

On the third upper support 21C, guide sections 23A and 23B are provided. The guide sections 23A and 23B are brought into contact with side ends of an original document so as to regulate the conveyance direction of the original document to be sent from the first supporting section 21, to a predetermined direction.

Along the conveyance path shown by the thick broken line in FIG. 2B, an original document set on the first supporting section 21 is conveyed, and is discharged onto the second supporting section 22. At this time, the original document is sent from the first supporting section 21 toward the downstream side in the conveyance direction by the feed roller 11, and then is separated one by one by the separation roller 12A and the separation piece 12B. Thereafter, each original document is further conveyed toward the downstream side in the conveyance direction by the relay roller 13 and the conveying roller 14A, and is discharged onto the second supporting section 22 by the discharging roller 15A.

Between the conveying roller 14A and the discharging roller 15A along the conveyance path, a first transparent section 25A and a first document pressing member 27A are provided. Also, between the relay roller 13 and the conveying roller 14A along the conveyance path, a second transparent section 25B and a second document pressing member 27B are provided.

Specifically, the first transparent section 25A is provided on the FB section 4 side, and the second transparent section 25B, the first document pressing member 27A and the second document pressing member 27B are provided on the ADF section 5 side. In this illustrative embodiment, the first transparent section 25A and the second transparent section 25B are made of glass plates, and extend over a range wider than a width of an original document in a width direction (a front-rear direction in this illustrative embodiment) perpendicular to the conveyance direction.

The first document pressing member 27A and the second document pressing member 27B are formed of a metal or a hard resin material, and extend over a range wider than a width of an original document, similarly to the first transparent section 25A and the second transparent section 25B.

The first document pressing member 27A is biased toward the first transparent section 25A by a spring (not shown), thereby suppressing an original document passing while being in contact with the upper surface of the first transparent section 25A from floating from the first transparent section 25A. The second document pressing member 27B is biased toward the second transparent section 25B by a spring (not shown), thereby suppressing an original document passing while being in contact with the upper surface of the second transparent section 25B from floating from the second transparent section 25B.

Also, in the FB section 4, a third transparent section 25C is provided, and in the ADF section 5, a third document pressing member 27C is provided. In this illustrative embodiment, the third transparent section 25C is made of glass plates, similarly to the first transparent section 25A and the second transparent section 25B. However, the third transparent section 25C is different from the first transparent section 25A and the second transparent section 25B in that the third transparent section 25C has a sufficiently large area to which the an original document to be subjected to image reading can be fit entirely.

The third document pressing member 27C is made of a laminate of a foamed resin layer and a hard resin film layer. When the ADF section 5 is closed, the third document pressing member 27C comes into close contact with the third transparent section 25C side due to a slight elastic deformation, thereby suppressing an original document placed on the third transparent section 25C from floating from the third transparent section 25C.

In the FB section 4, a guide rail 29, a carriage 30, a first image sensor 31A (an example of a reading unit), and the like are provided. In the ADF section 5, a second image sensor 31B is provided. The guide rail 29 is formed integrally with an inner surface of a bottom portion of a housing 4A of the FB section 4 and extends in a left-right direction of this illustrative embodiment in a range from a lower side of the first transparent section 25A to a lower side of the third transparent section 25C, in parallel to the lower surfaces of the first transparent section 25A and the third transparent section 25C.

The carriage 30 is mounted on the guide rail 29, thereby being supported so as to be able to reciprocate in the left-right direction along the guide rail 29. The carriage 30 is connected to a timing belt (not shown), and reciprocates in the left-right direction in conjunction with circulation of the timing belt.

In the present illustrative embodiment, as the first image sensor 31A and the second image sensor 31B, contact image sensors (CISs) are used. The first image sensor 31A is mounted on the carriage 30, and reciprocates in the left-right direction together with the carriage 30.

Between the first image sensor 31A and the second image sensor 31B, a spring (not shown) is interposed. The spring 33A biases the first image sensor 31A in an upper direction. Also, in the vicinities of the front and rear ends of the first image sensor 31A, spacers (not shown) are attached. The spacers are biased in an upper direction together with the first image sensor 31A, thereby coming into contact with the lower surface of the third transparent section 25C or the first transparent section 25A.

Therefore, when the first image sensor 31A reciprocates together with the carriage 30, the spacers are kept in a state where the spacers are in contact with the lower surface of the third transparent section 25C or the first transparent section 25A, so the first image sensor 31A moves while keeping a constant distance from the third transparent section 25C or the first transparent section 25A.

The second image sensor 31B is disposed at a predetermined position, and does not move from the predetermined position. However, the second image sensor 31B is biased toward the second transparent section 25B by a spring (not shown). Therefore, the second image sensor 31B also keeps a constant distance from the second transparent section 25B.

A plurality of reading elements of each of the first image sensor 31A and the second image sensor 31B are arranged in the front-rear direction of this illustrative embodiment. In a case of reading an image of an original document placed on the upper surface of the third transparent section 25C, the first image sensor 31A reads an image while moving together with the carriage 30.

Meanwhile, in a case of reading an image of an original document which is conveyed by the conveyor 10, the first image sensor 31A stops at a lower side of the first document pressing member 27A and the first transparent section 25A, and reads an image of the original document passing while being in contact with the upper surface of the first transparent section 25A. The second image sensor 31B is positioned on a lower side of the second document pressing member 27B and the second transparent section 25B, and reads an image of an original document passing while being in contact with the upper surface of the second transparent section 25B.

[Details of Guide Sections]

Figure 4:
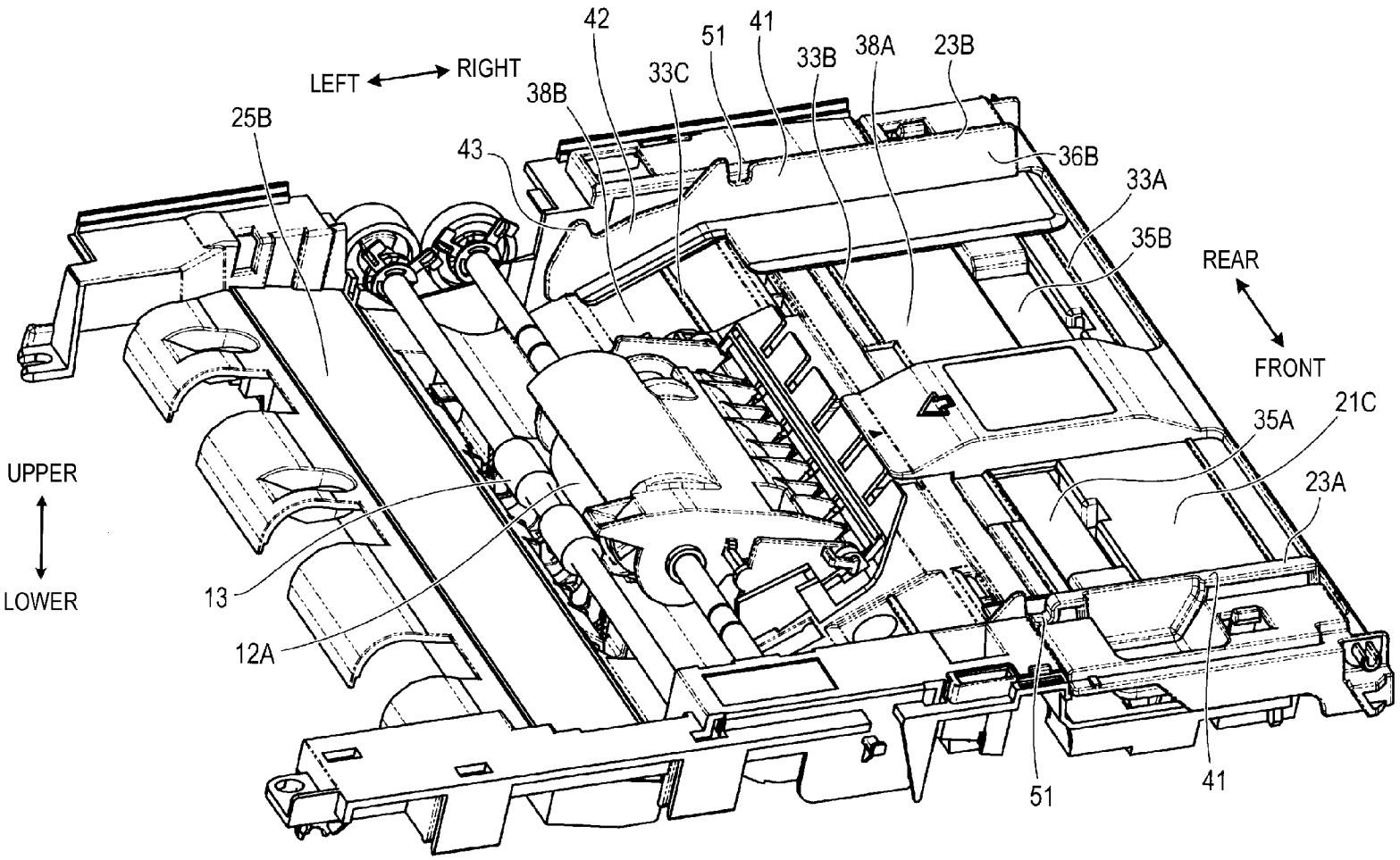
FIG. 4 is a perspective view showing a rear side guide section and a surrounding structure.
Figure 5:
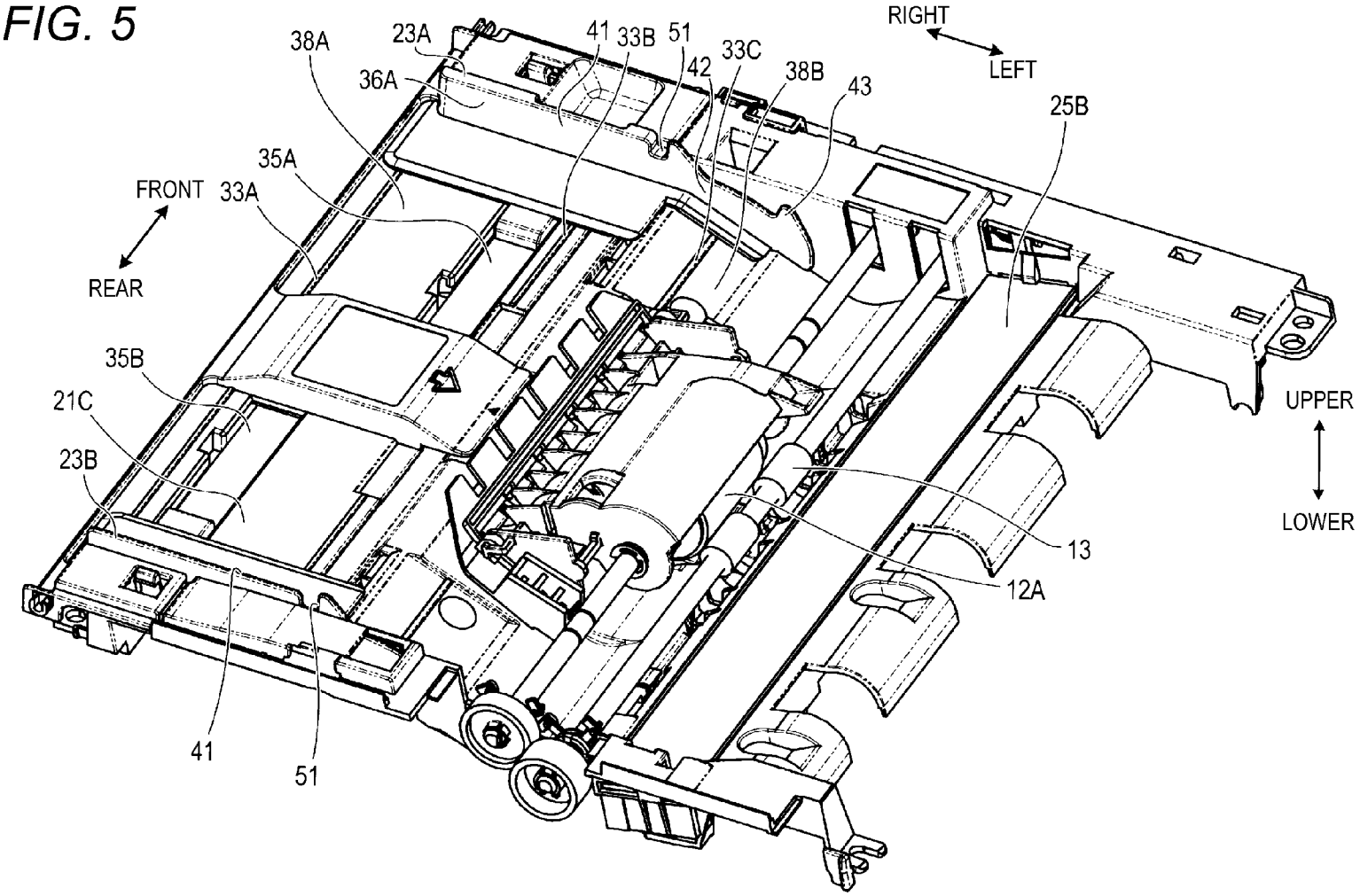
FIG. 5 is a perspective view showing a front side guide section and a surrounding structure.

Subsequently, the pair of guide sections 23A and 23B, and the surrounding structures of them will be described in detail. As shown in FIGS. 4 and 5, the guide sections 23A and 23B are provided on the third upper support 21C corresponding to a portion of the first supporting section 21, with an interval in the width direction (the front-rear direction in the drawings) perpendicular to the conveyance direction.

The guide sections 23A and 23B are configured to be relatively slidable in the front-rear direction with respect to the third upper support 21C. On the upper surface of the third upper support 21C, protrusions 33A, 33B and 33C are formed, and the bottoms of the guide sections 23A and 23B are supported in a state where they are in contact with tip ends of the protrusions 33A, 33B and 33C. Therefore, as compared to a case where those protrusions 33A, 33B and 33C are not provided, the sliding friction on the bottom surfaces of the guide sections 23A and 23B becomes lower, and thus the guide sections 23A and 23B smoothly slide.

In the guide section 23A, a rack 35A is provided so as to extend toward the rear side, and in the guide section 23B, a rack 35B is provided so as to extend toward the front side. A single pinion (not shown) is provided at the center of the third upper support 21C in the front-rear direction, such that the pinion is interposed between the racks 35A and 35B in the left-right direction, and the racks 35A and 35B are engaged with the pinion.

Accordingly, if any one guide section (for example, the guide section 23A) of the guide sections 23A and 23B is slid, one rack (for example, the rack 35A) rotates the pinion. If the pinion rotates, the pinion slides the other rack (for example, the rack 35B) in the opposite direction to the sliding direction of the one rack. As a result, the other guide section (for example, the guide section 23B) having the other rack slides on the pinion in the opposite direction to the sliding direction of the one guide section. The guide sections 23A and 23B have contact surfaces 36A and 36B facing each other in the front-rear direction, and guide an original document fed from the first supporting section 21 toward the downstream side in the conveyance direction along the contact surfaces 36A and 36B.

Figure 6A:
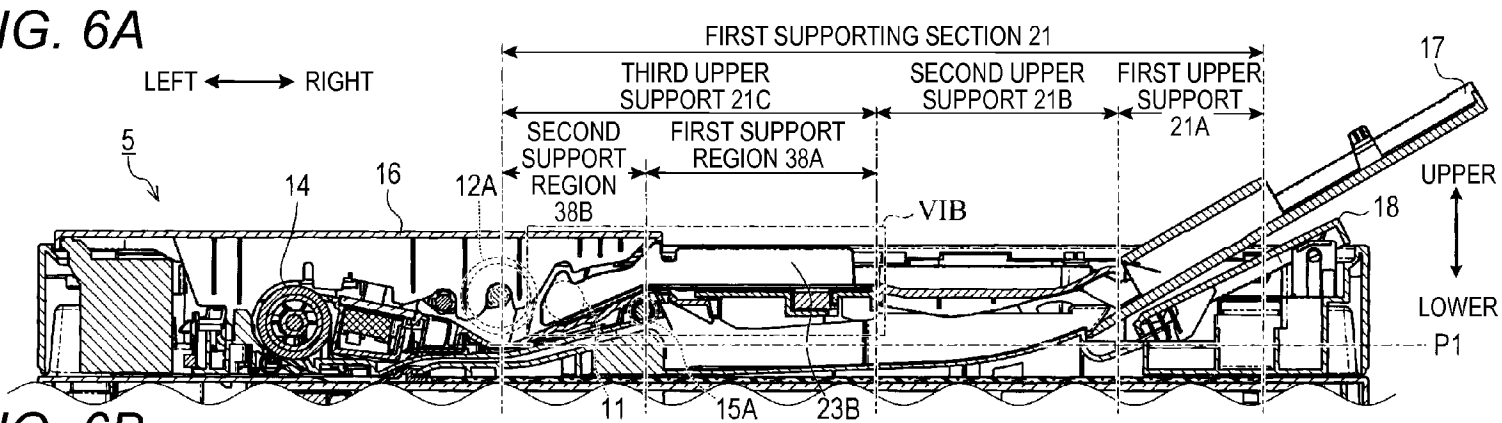
FIG. 6A is a vertical cross-sectional view taken along a position where the rear side guide section can be seen.
Figure 6B:
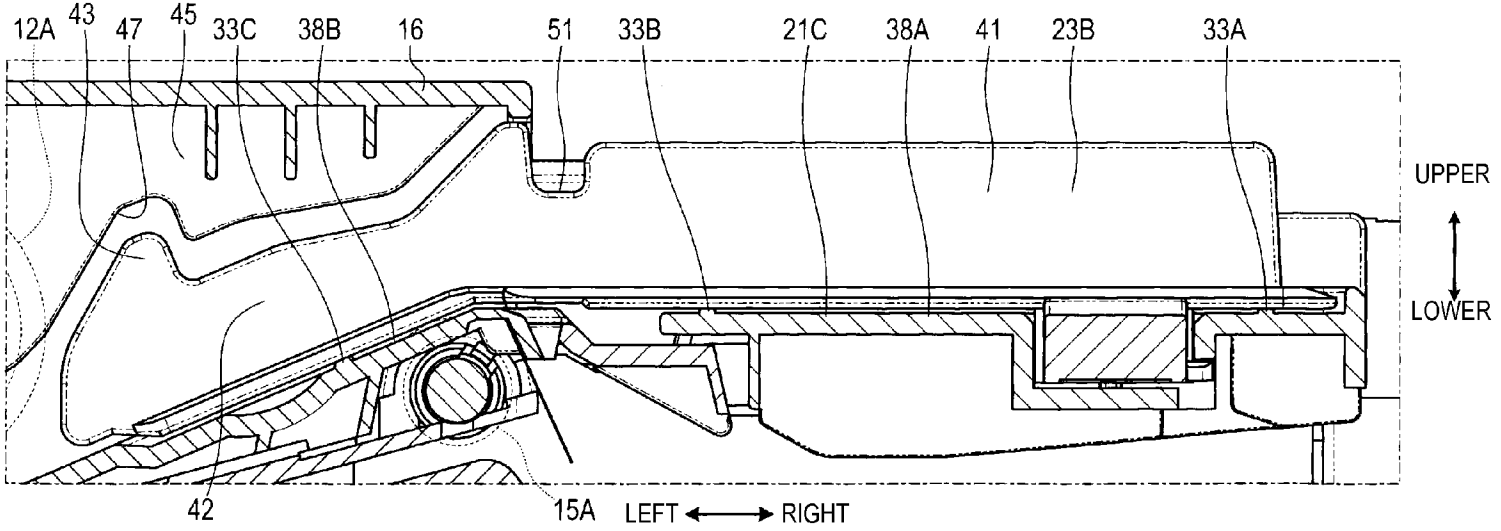
FIG. 6B is an enlarged view showing a vertical cross section of a portion VIB of FIG. 6A.

As shown in FIGS. 6A and 6B, the third upper support 21C includes a first support region 38A which extends substantially horizontally, and a second support region 38B which is inclined in a lower direction toward the downstream side in the conveyance direction. As shown in FIG. 6A, the discharging roller 15A is disposed on the lower side of a range where the first supporting section 21 is provided, and on the upper side of the position P1 of the lower end of the second support region 38B. The first cover 16 is an example of an upper cover. When the first cover 16 is at a closed position (the position shown in FIG. 2A), the first cover 16 covers the upper side of the second support region 38B, and when the first cover 16 is moved to an open position, the second support region 38B is exposed.

As shown in FIGS. 4, 5, 6A and 6B, each of the guide sections 23A and 23B has a first portion 41 which extends substantially horizontally along the first support region 38A, and a second portion 42 which is connected to the first portion 41 and extends obliquely in the lower direction along the second support region 38B.

Also, as shown in FIGS. 4 and 5, since the shapes of the first portion 41 and the second portion 42 of the guide section 23A are substantially the same as those of the guide section 23B, the following description will be made with reference to FIGS. 6A to 10 showing the guide section 23B disposed on the rear side.

In each of the guide sections 23A and 23B, an end portion of the second portion 42 on the downstream side in the conveyance direction (the left side in the drawings) extends to the vicinity of the separation roller 12A as seen from the front side of the device. Also, in each of the guide sections 23A and 23B, at an upper edge of the second portion 42, a regulating section 43 (an example of a first protrusion) is formed so as to protrude in the upper direction from the upper edge. If an original document is displaced in such a direction that the original document will exceed the upper edges of the guide sections 23A and 23B located at positions lower than the regulating sections 43, the regulating sections 43 regulate that displacement.

Figure 7:
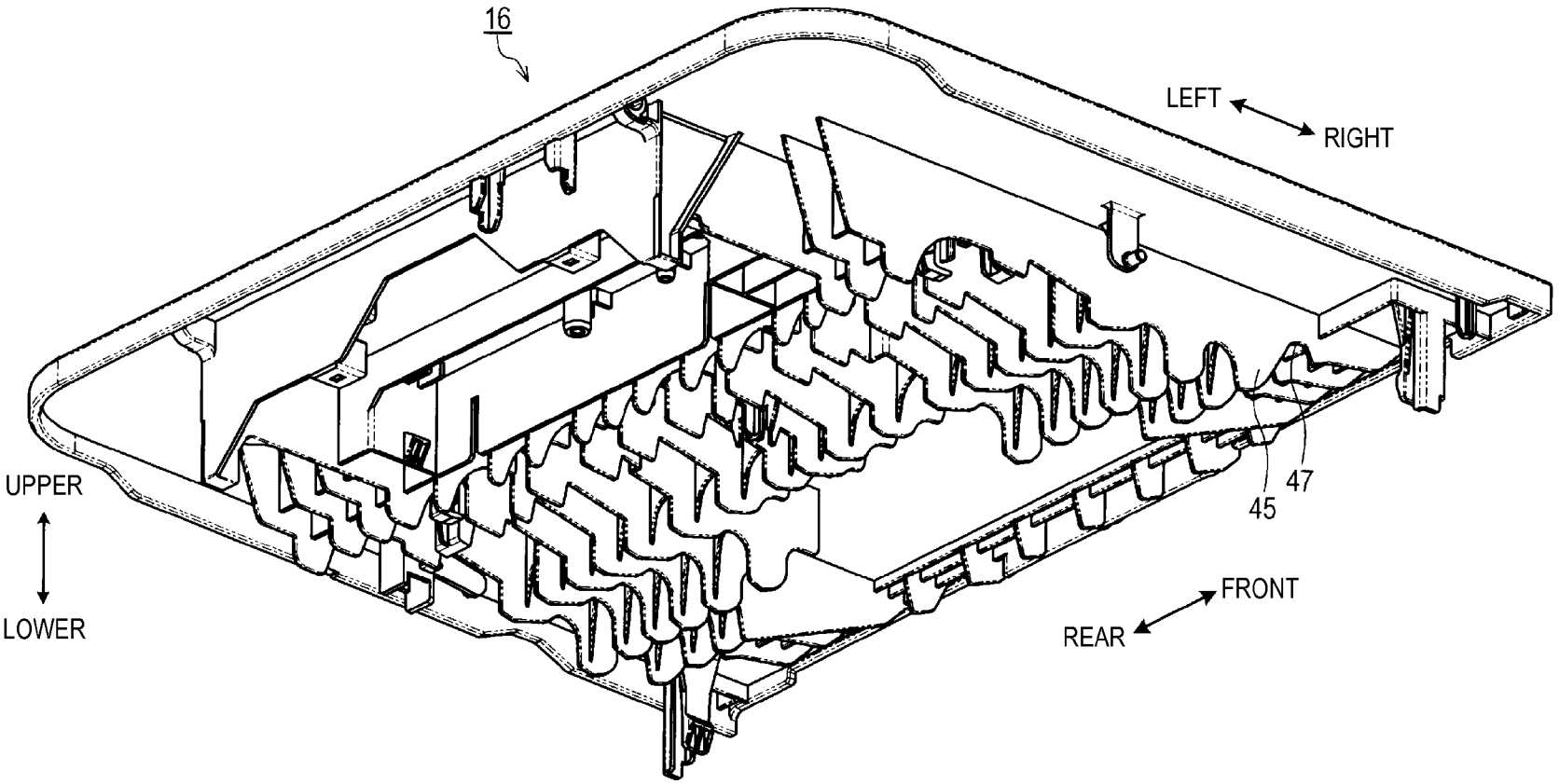
FIG. 7 is a perspective view showing a first cover.

On the upper side of the second support regions 38B, the lower side of the first cover 16 is provided with ribs 45 which protrude toward the second support regions 38B. In each of the rib 45, an accommodating section 47 is formed in a recess shape according to the regulating section 43 protruding toward the rib 45. As shown in FIG. 7, the lower side of the first cover 16 is provided with a plurality of ribs 45 arranged in parallel. Of these ribs 45, three foremost ribs 45 and three rearmost ribs 45 face moving ranges of the guide sections 23A and 23B and can interfere with the regulating sections 43. In order to avoid this interference, the accommodating sections 47 are formed in those six ribs 45.

At the upper edges of the guide sections 23A and 23B, as shown in FIGS. 6A and 6B, contact prevention sections 51 are formed in recess shapes extending in the lower direction. The contact prevention sections 51 are provided for preventing the second cover 17 from coming into contact with the guide sections 23A and 23B when the second cover 17 including the second supporting section 22 is moved to the storage position.

Figure 8:
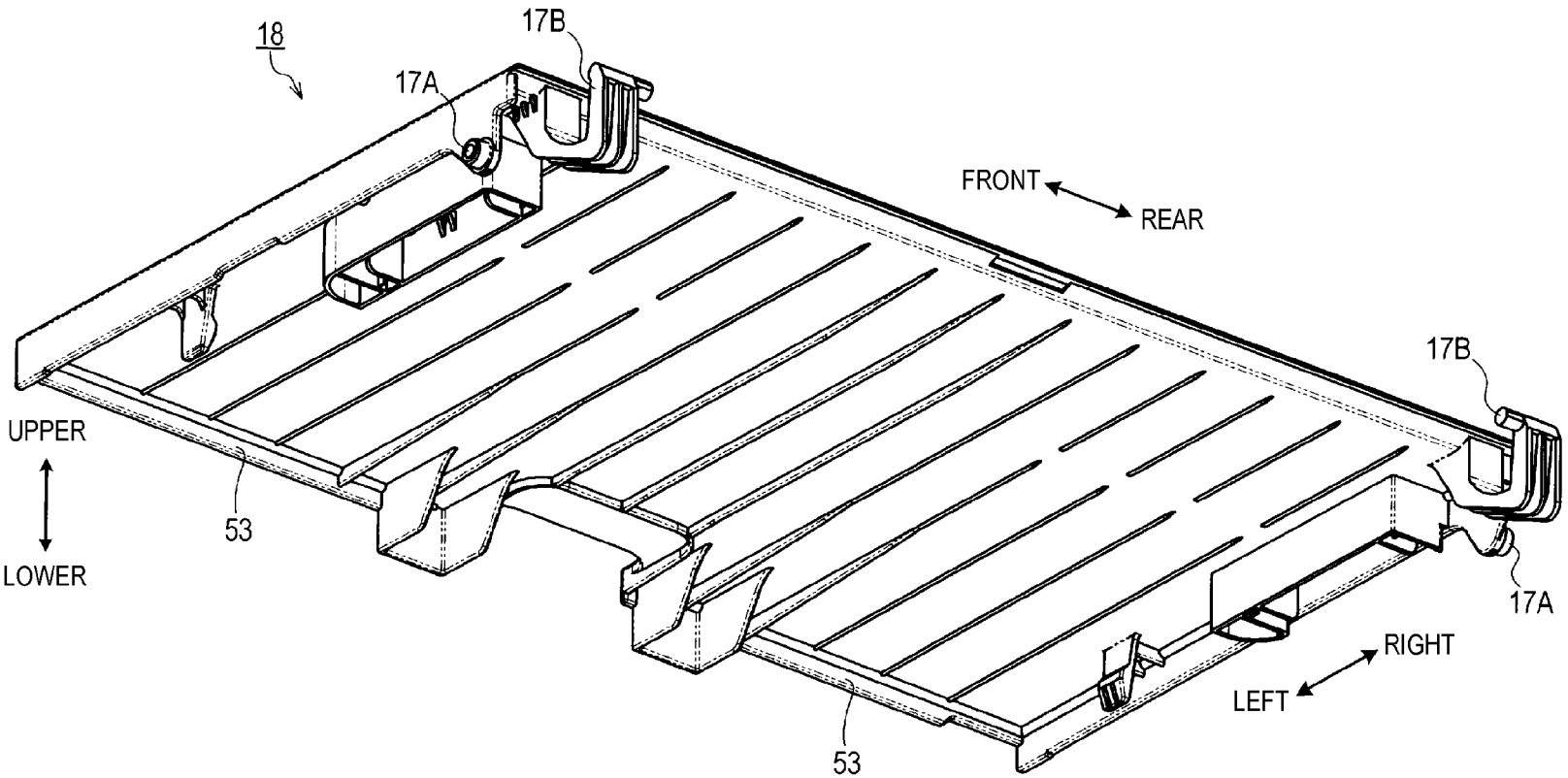
FIG. 8 is a perspective view showing the second cover.

Specifically, at the position of the left end of the second cover 17 in a state where the second cover 17 is at the storage position, as shown in FIG. 8, protrusions 53 (an example of a second protrusion) are provided such that they protrude toward the lower side (the first support region 38A side). Since these protrusions 53 are provided, it is possible to improve the rigidity of the second cover 17 against bending or twisting.

Figure 9:
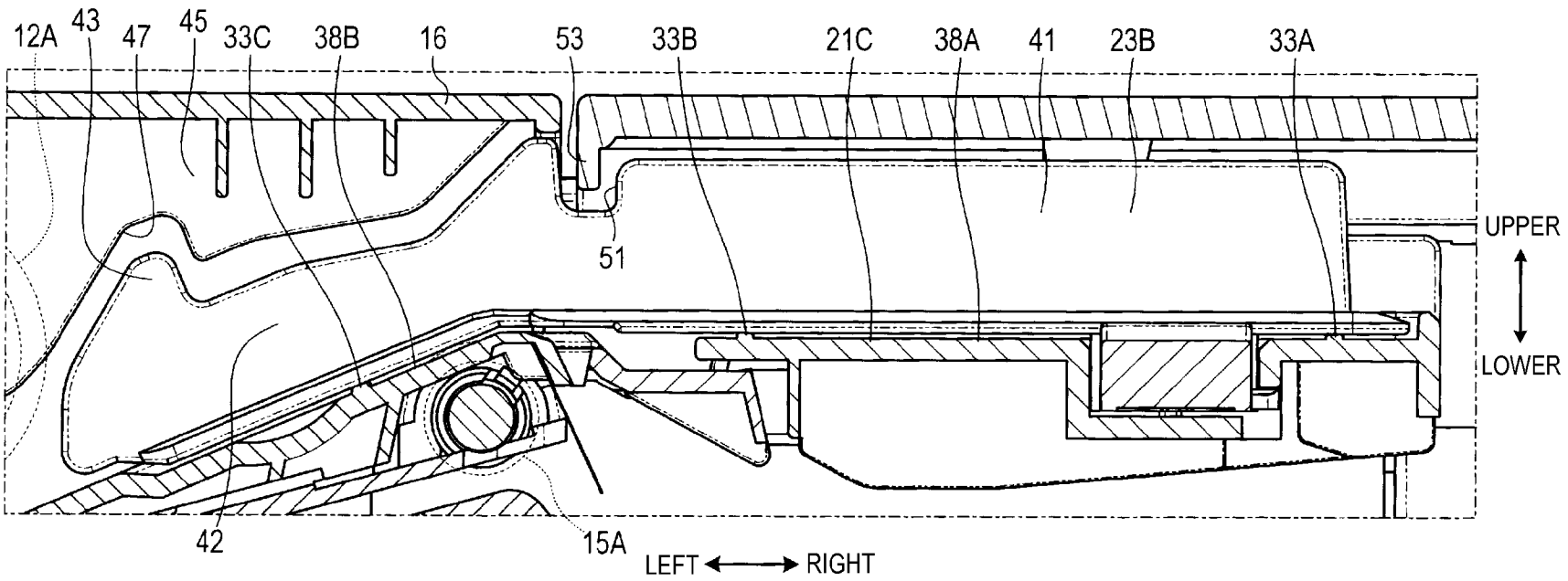
FIG. 9 is a vertical cross-sectional view showing a portion including a protrusion formed at an end edge of the second cover and a contact prevention section formed on a guide section.

When the second cover 17 is moved to the storage position, the protrusions 53 enter the contact prevention sections 51, as shown in FIG. 9. That is, the shapes and the like of the contact prevention sections 51 are set in view of the shapes and positions of the protrusions 53.

[Effects]

In the above-described multi-function device 1, the reading unit 3 and the ADF section 5 have the following effects. That is, in the third upper support 21C and the guide sections 23A and 23B of the ADF section 5, portions (the first support region 38A and the first portion 41) on the upstream side in the conveyance direction extend substantially horizontally. Meanwhile, portions (the second support region 38B and the second portion 42) on the downstream side in the conveyance direction extend obliquely in the lower direction toward the downstream side in the conveyance direction. Therefore, the first supporting section 21 having the above-described substantially horizontal portion reduces the height of the vicinity of the first support region 38A as compared to a related-art device wherein the whole of the first supporting section 21 including a portion located on the upstream side in the conveyance direction is inclined. Therefore, it is possible to reduce the thickness of the device.

Further, in the ADF section 5, if an original document is guided along the second portions 42 of the guide sections 23A and 23B, the original document reaches the separation roller 12A in a state where the original document is conveyed in an appropriate conveyance direction in the vicinity of the separation roller 12A. Therefore, as compared to a case where the guide sections 23A and 23B are provided at positions spaced away from the separation roller 12A, it is possible to improve an effect of suppressing skew of an original document.

Further, according to the above-described ADF section 5, when a plurality of original documents are stacked on the first supporting section 21, even if an original document is displaced in such a direction (direction perpendicular to the conveyance direction) that the original document exceeds the upper edges of the second portions 42 of the guide sections 23A and 23B, the end portion of the original document comes into contact with the regulating sections 43, whereby displacement of the original document is regulated. Therefore, even if a lot of original documents are loaded on the first supporting section 21, the uppermost original document is not likely to deviate to an unexpected position over the upper edges of the second portions 42, so that it is possible to appropriately suppress shift or skew of the original document.

Also, according to the above-described ADF section 5, even if an original document is displaced in such a direction that the original document exceeds the regulating sections 43 of the guide sections 23A and 23B, a range in which the original document can be displaced is regulated by the lower edges of the ribs 45. Especially, since the convex regulating sections 43 are accommodated in the concave accommodating sections 47, whereby protrusions and recesses are interlaced around the regulating sections 43 and the accommodating sections 47, an original document cannot pass through the interlaced portion. Therefore, an effect of preventing an original document from deviating to an unexpected position over the regulating sections 43 is rather high, and it is possible to more surely suppress shift or skew of an original document.

Further, according to the above-described ADF section 5, since the ribs 45 are formed on the first cover 16, if the first cover 16 is moved to the closed position, the ribs 45 are disposed at predetermined positions. Therefore, between the second portions 42 of the guide sections 23A and 23B, an original document is conveyed while being pressed from the upper side by the ribs. Therefore, it is possible to suppress displacement of an original document in the vertical direction, thereby capable of conveying the original document in a stable state. Further, it is possible to suppress a range in which an original document can be displaced, by the lower edges of the ribs 45.

Further, according to the above-described ADF section 5, since the contact prevention sections 51 are provided, even if the protrusions 53 are provided on the first cover 16 including the second supporting section 22, it is possible to prevent the protrusions 53 from coming into contact with the upper edges of the guide sections 23A and 23B. Therefore, as compared to a case of using guide sections 23A and 23B without such contact prevention sections 51, even if the second supporting section 22 having the protrusions 53 is disposed at a lower position, it is possible to prevent interference between the protrusions 53 and the guide sections 23A and 23B, so that it is possible to reduce the thickness of the device.

Further, according to the above-described ADF section 5, the guide sections 23A and 23B slide while being in contact with the tip ends of the protrusions 33A, 33B and 33C (an example of a third protrusion). Therefore, as compared to a case where the guide sections 23A and 23B slide along a surface without those protrusions 33A, 33B and 33C, it is possible to reduce the sliding friction on the guide sections 23A and 23B, and it is possible to improve the operability of the guide sections 23A and 23B.

Further, according to the above-described ADF section 5, the discharging roller 15A is disposed at a position higher than the lower ends of the second support regions 38B extending obliquely in the lower direction toward the downstream side in the conveyance direction. Therefore, as compared to a case where the discharging roller 15A is disposed at a position lower than the position of the lower end of the entire first supporting section 21, it is possible to lower the height position of the first supporting section 21, so that it is possible to reduce the thickness of the device.

[Other Illustrative Embodiments]

Although the sheet conveying device and the image reading device have been described above using the specific illustrative embodiment configured as the multi-function device 1, the present invention is not limited to the above described illustrative embodiment, and the inventive concept of the present invention can be implemented in various forms without departing from the technical idea of the present invention.

Figure 10:
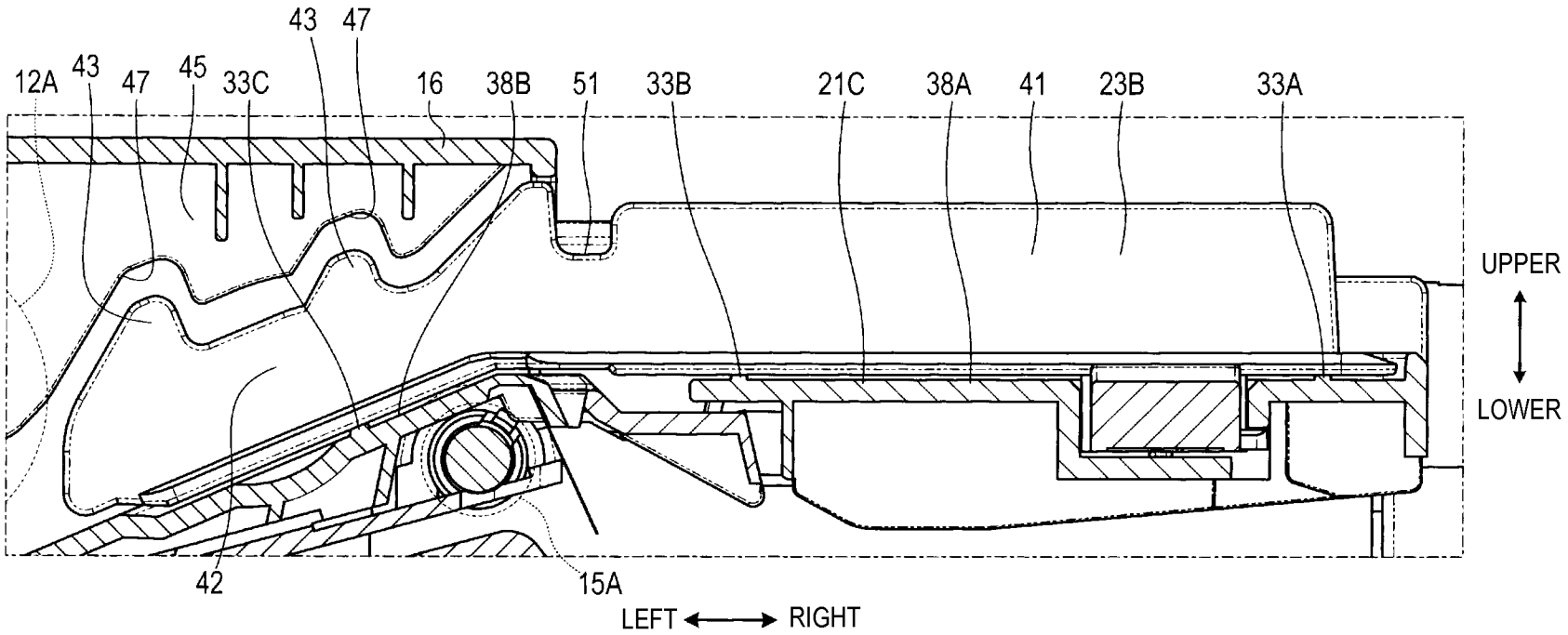
FIG. 10 is a vertical cross-sectional view showing a portion including a guide section and a rib according to another illustrative embodiment.

For example, in the above-described illustrative embodiment, at each of the guide sections 23A and 23B, one regulating section 43 is provided, and in each rib 45, one accommodating section 47 is formed accordingly. However, the number of regulating sections 43 or accommodating sections 47 is not limited to one. For example, as shown in FIG. 10, at each of the guide sections 23A and 23B, a plurality of regulating sections 43 may be provided at the upper edge of the second portion 42. In this case, in each rib 45, a plurality of accommodating sections 47 may be formed at a plurality of positions corresponding to the plurality of regulating sections 43, respectively.

According to this configuration, as compared to the case where each guide section has only a single regulating section 43, it is possible to improve the effect of preventing an original document from deviating to an unexpected position over the regulating sections 43.

Further, in the above-described illustrative embodiment, the reading unit 3 includes the first image sensor 31A and the second image sensor 31B. However, it is arbitrary whether the reading unit 3 includes any component corresponding to the second image sensor 31B.

Further, in the above-described illustrative embodiment, a case where the reading unit 3 is assembled in the multi-function device 1 has been described. However, the above-described configuration may be applied to a mono-functional image scanner device.

What is claimed is:

1. A sheet conveying device comprising:

a conveyor which is configured to convey a sheet along a predetermined conveyance path in a conveyance direction;

a first supporting section which is configured to support a sheet to be fed to the conveyor, from a lower side of the sheet;

a second supporting section which is configured to support a sheet discharged from the conveyor, from the lower side of the sheet; and a guide section which is provided on the first supporting section and configured to guide a sheet to be fed from the first supporting section to the conveyor, wherein the first supporting section includes a first support region and a second support region, each of which is configured to support a sheet, and a third support region which is provided at a position on an upstream side with respect to both the first support region and the second support region in the conveyance direction, wherein the first support region is provided at a position on an upstream side with respect to the second support region in the conveyance direction, and the second support region is provided at a position on a downstream side with respect to the first support region in the conveyance direction, wherein the first support region extends substantially horizontally, and the second support region is inclined in a lower direction toward the downstream side in the conveyance direction, wherein the guide section includes a first portion which extends substantially horizontally along the first support region, a second portion which is connected to the first portion and extends obliquely in the lower direction along the second support region, and a flat face portion which supports the sheet from a lower side of the sheet with the first supporting section and a side wall portion which stands upward from the flat face portion and guides an edge of the sheet, wherein the flat face portion of the guide section has a first section that is provided within the first support region and a second section which is provided within the second support region, wherein the second supporting section is configured to be movable between a storage position for covering an upper side of the first support region and a use position for exposing the first support region, and the second supporting section is configured to support a sheet discharged from the conveyor, from the lower side of the sheet, in a state where the second supporting section is at the use position, wherein the second supporting section includes a second protrusion which protrudes toward the first support region in a state where the second supporting section is at the storage position, and wherein an upper edge of the guide section is formed with a contact prevention section in a recess shape so as to prevent contact with the second protrusion in the state where the second supporting section is at the storage position.

2. The sheet conveying device according to claim 1, wherein the conveyor includes a separation roller which is configured to separate a plurality of sheets supported on the first supporting section one by one, and to send each sheet toward the downstream side in the conveyance direction, and wherein an end portion of the second portion of the guide section on the downstream side in the conveyance direction extends to a vicinity of the separation roller.

3. The sheet conveying device according to claim 1, wherein the guide section includes a first protrusion which is provided on an upper edge of the second portion so as to protrude in an upper direction from the upper edge.

4. The sheet conveying device according to claim 3, wherein the first protrusion is configured to regulate a displacement of a sheet over the upper edge.

5. The sheet conveying device according to claim 1, wherein the guide section is attached to a part of the first supporting section so as to be slidable, and wherein the part of the first supporting section is formed with a third protrusion extending in a sliding direction of the guide section at a position where the guide section slides.

6. The sheet conveying device according to claim 1, wherein the conveyor includes a discharging roller which is configured to discharge a conveyed sheet to the second supporting section, and wherein the discharging roller is disposed at a position on a lower side with respect to the first supporting section and on an upper side with respect to a position of a lower end of the second support region.

7. The sheet conveying device according to claim 1, wherein the guide section includes a contact surface configured to come into contact with an end portion of a sheet supported by the first supporting section, in a width direction perpendicular to the conveyance direction.

8. The sheet conveying device according to claim 1, wherein the conveyor includes a discharging roller which is configured to discharge a conveyed sheet to a second supporting section which is configured to support a sheet discharged from the conveyor, from the lower side of the sheet, and wherein the discharging roller is disposed at a position on a lower side with respect to the first supporting section and on an upper side with respect to a position of a lower end of the second support region.

9. A sheet conveying device comprising:

a conveyor which is configured to convey a sheet along a predetermined conveyance path in a conveyance direction;

a first supporting section which is configured to support a sheet to be fed to the conveyor, from a lower side of the sheet; and a guide section which is provided on the first supporting section and configured to guide a sheet to be fed from the first supporting section to the conveyor, wherein the first supporting section includes a first support region and a second support region, each of which is configured to support a sheet, wherein the first support region is provided at a position on an upstream side with respect to the second support region in the conveyance direction, and the second support region is provided at a position on a downstream side with respect to the first support region in the conveyance direction, wherein the first support region extends substantially horizontally, and the second support region is inclined in a lower direction toward the downstream side in the conveyance direction, wherein the guide section includes a first portion which extends substantially horizontally along the first support region, and a second portion which is connected to the first portion and extends obliquely in the lower direction along the second support region, wherein the guide section includes a first protrusion which is provided on an upper edge of the second portion so as to protrude in an upper direction from the upper edge, wherein the first protrusion is configured to regulate a displacement of a sheet over the upper edge, wherein on an upper side of the second support region, a rib is provided to protrude toward the second support region, and wherein the rib is formed with an accommodating section in a recess shape according to the first protrusion protruding toward the rib such that the accommodating section accommodates the first protrusion.

10. The sheet conveying device according to claim 9, wherein the guide section includes a plurality of first protrusions which are provided on the upper edge of the second portion, and wherein the rib is formed with a plurality of accommodating sections at positions corresponding to the plurality of first protrusions, respectively.

11. The sheet conveying device according to claim 9, further comprising:

an upper cover which is configured to be movable between a closed position for covering the upper side of the second support region and an open position for exposing the second support region, wherein the rib is formed on the upper cover at a position facing the second support region in a state where the upper cover is at the closed position.

12. An image reading device comprising:

a conveyor which is configured to convey a sheet along a predetermined conveyance path in a conveyance direction;

a first supporting section which is configured to support a sheet to be fed to the conveyor, from a lower side of the sheet;

a second supporting section which is configured to support a sheet discharged from the conveyor, from the lower side of the sheet;

a guide section which is provided on the first supporting section and configured to guide a sheet to be fed from the first supporting section to the conveyor; and a reading unit which is configured to read an image of a sheet conveyed by the conveyor, wherein the first supporting section includes a first support region and a second support region, each of which is configured to support a sheet, and a third support region which is provided at a position on an upstream side with respect to both the first support region and the second support region in the conveyance direction, wherein the first support region is provided at a position on an upstream side with respect to the second support region in the conveyance direction, and the second support region is provided at a position on a downstream side with respect to the first support region in the conveyance direction, wherein the first support region extends substantially horizontally, and the second support region is inclined in a lower direction toward the downstream side in the conveyance direction, wherein the guide section includes a first portion which extends substantially horizontally along the first support region, a second portion which is connected to the first portion and extends obliquely in the lower direction along the second support region, and a flat face portion which supports the sheet from a lower side of the sheet with the first supporting section and a side wall portion which stands upward from the flat face portion and guides an edge of the sheet, wherein the flat face portion of the guide section has a first section that is provided within the first support region and a second section which is provided within the second support region, wherein the second supporting section is configured to be movable between a storage position for covering an upper side of the first support region and a use position for exposing the first support region, and the second supporting section is configured to support a sheet discharged from the conveyor, from the lower side of the sheet, in a state where the second supporting section is at the use position, wherein the second supporting section includes a second protrusion which protrudes toward the first support region in a state where the second supporting section is at the storage position, and wherein an upper edge of the guide section is formed with a contact prevention section in a recess shape so as to prevent contact with the second protrusion in the state where the second supporting section is at the storage position.

* * * * *